US005970903A

United States Patent [19]

McDonough et al.

[11] Patent Number: 5,970,903

[45] Date of Patent: Oct. 26, 1999

[54] KINESTHETIC KAYAK COCKPIT SEAT ASSEMBLY

[75] Inventors: Bob James McDonough, Asheville, N.C.; Todd Dean King, Greenville, S.C.; Aaron Lee Phillips, Montrose, Colo.; David Maughan, Missoula, Mont.

[73] Assignee: Perception, Inc., Easley, S.C.

[21] Appl. No.: 09/116,153

[22] Filed: Jul. 16, 1998

[51] Int. Cl.[6] ..... B63B 35/00

[52] U.S. Cl. ..... 114/347; 114/363

[58] Field of Search ..... 114/363, 347

[56] References Cited

U.S. PATENT DOCUMENTS

| | | | |
|---|---|---|---|
| 4,229,850 | 10/1980 | Arcouette | 114/347 |
| 4,407,216 | 10/1983 | Masters | 114/347 |
| 4,589,365 | 5/1986 | Masters | 114/347 |
| 4,727,821 | 3/1988 | Masters | 114/347 |
| 5,493,982 | 2/1996 | Carpenter et al. | 114/347 |

*Primary Examiner*—Jesus D. Sotelo
*Attorney, Agent, or Firm*—Cort Flint

[57] ABSTRACT

A kinesthetic seat assembly is disclosed for a watercraft used in white water conditions of the type having a hull and a cockpit opening formed in the hull for access to a cockpit seat assembly of the watercraft. The seat assembly includes a contoured seat with a pair of opposing contoured upper leg supports, a contoured buttock support, and an adjustable kinesthetic crotch pod assembly. The crotch pad assembly is carried by a medial portion of the seat assembly between the opposing upper leg supports, and includes a crotch pod constructed from a shapeable material which may be contoured and customized for the anatomy of an individual boater. An adjustment mechanism mounts the crotch pod to the medial portion of the seat assembly for adjusting the position of the crotch pod on the medial portion in a longitudinal direction relative to a longitudinal axis of the kayak to fit the boater. The crotch pod is contoured and arranged to accommodate the boater in the seat assembly in a kinesthetic manner so that movements of the boater may be imparted to the watercraft for guidance and control.

32 Claims, 4 Drawing Sheets

Fig. 3.
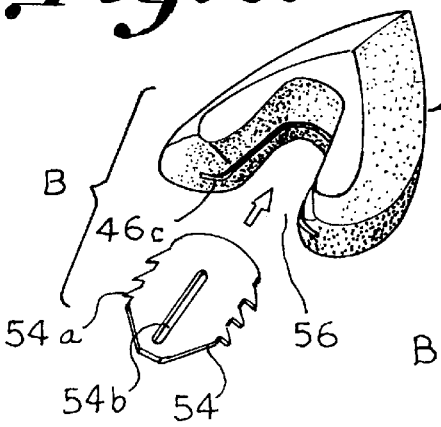
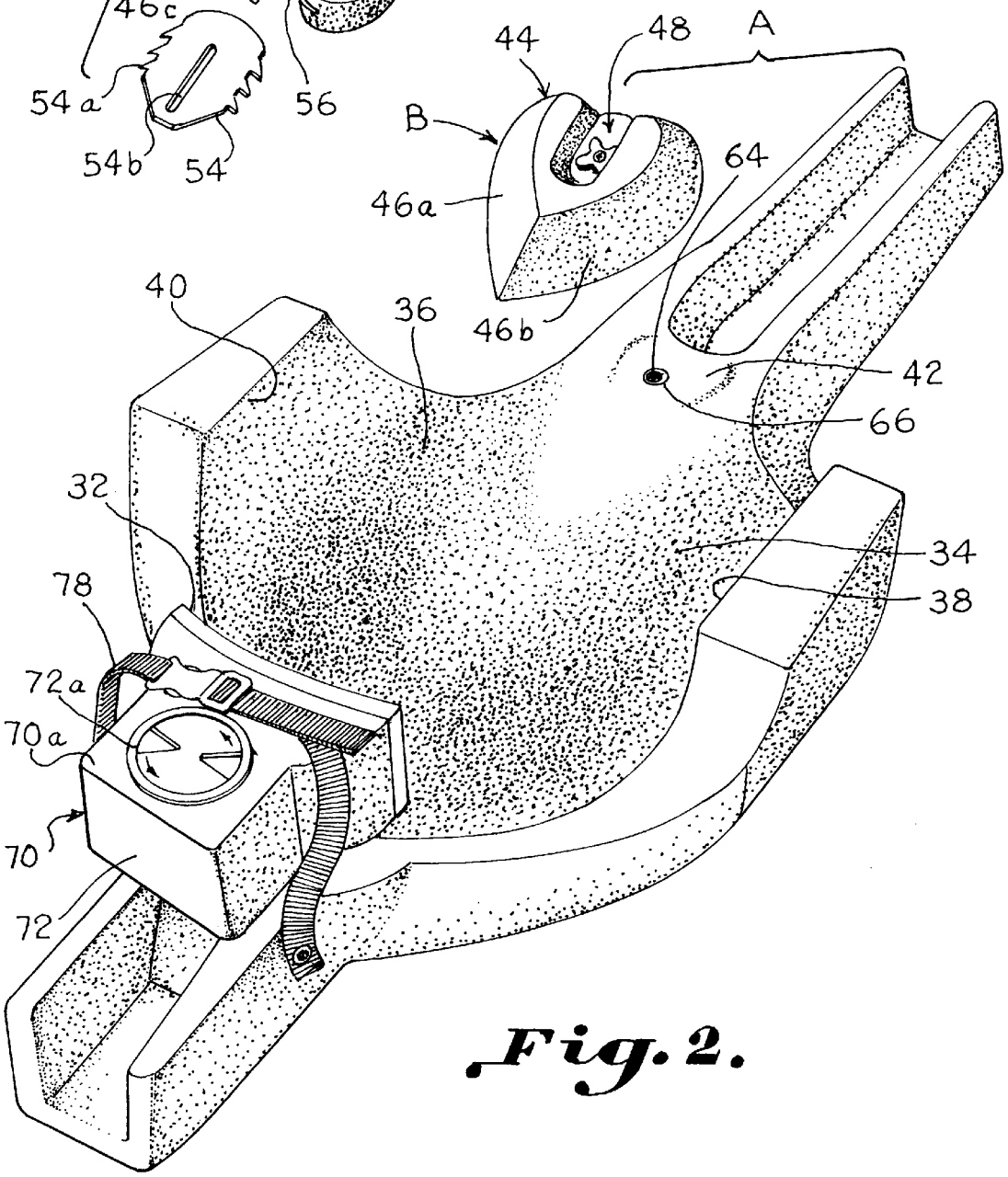
Fig. 2.

KINESTHETIC KAYAK COCKPIT SEAT ASSEMBLY

BACKGROUND OF THE INVENTION

The invention relates to a cockpit seat assembly for a kayak and the like watercraft wherein the seat assembly is contoured for accommodating the body of a boater in a kinesthetic seated position within the watercraft for increased guidance and control of the watercraft in white water and other rigorous water conditions.

Heretofore, kayaks and the like watercraft have been provided which are constructed from a flexible plastic skin or other resin material wherein the boater is seated in a cockpit seat within the hull of the watercraft. Such kayaks are designed to withstand the impact of the water and various obstacles encountered in white water conditions. However, with the increasing popularity of white water boating, and particularly kayak rodeos, the provision of a supportive cockpit seat which accommodates the human anatomy of the boater in a safe and supportive manner with increased guidance and control is a problem to which considerable attention needs be given.

Heretofore, kayak cockpit seats have been molded in a single piece construction to provide a seat contoured for the buttocks of a boater such as shown in U.S. Pat. Nos. 4,407,216; 4,589,365; 4,727,821; and 5,493,982. In connection with such seats it has been known to mount a foam block as a lower back support in the rear of the cockpit seat. The block is mounted by means of a two spaced apart rearwardly extending sides between which a rear support is sandwiched. The block is then strapped to the seat. However the problem occurs that the block easily twists relative to the support and one of the sides becomes dislodged. It also has been known to place a foam block between the legs of a boater to support the boater in the seat between the sides of the kayak. The block is often sanded or carved to accommodate the boater. While the above seats have been suitable, as the rigors of white water kayaking and white water rodeos has increased, the need for a more kinesthetically supporting seat is needed to provide more safety and control over the guidance of the kayak.

Accordingly, an important object of the invention is to provide a cockpit seat assembly for a watercraft which supports the body of a boater in an anatomically correct manner during rigorous white boating conditions.

Still another important object of the present invention is to provide a cockpit seat assembly for a watercraft wherein the boater is accommodated in a supportive manner against forward longitudinal thrust encountered in white water and white water rodeo conditions.

Still another important object of the present invention is to provide cockpit seat assembly which is kinesthetically contoured to fit the boater and kayak together as one so that a boater may use his body movements to exert additional guidance and control to the kayak.

Yet another object of the present invention is to provide a integral cockpit seat assembly which is kinesthetically designed to accommodate the body of a boater in white water and other rigorous water conditions wherein the seat supports may be adjusted and contoured to fit the anatomy of an individual boater and hold the boater in a supportive manner during the rigorous forces encountered in the white water and rodeo conditions.

Still another important object of the present invention is to provide a cockpit seat assembly which supports the anatomy of a boater in such a manner that the boater and watercraft are integrated as one so the boater may use his body movements to impart guidance to the watercraft.

SUMMARY OF THE INVENTION

The above objectives are accomplished according to the present invention by providing a watercraft for use in white water conditions with a hull having an upper deck and a cockpit opening formed in the upper deck of the hull for entering and exiting an interior cockpit of the watercraft. A kinesthetic seat assembly is carried within the hull being accessible through the cockpit opening. A pair of opposing thigh braces are carried within the cockpit on opposing sides of the seat assembly. The seat assembly has a contoured seat and includes a pair of opposing contoured upper leg supports, a contoured buttock support portion, and a contoured lower back support. A medial portion is formed between the opposing upper leg supports, with a crotch pod assembly being carried by the medial portion of the seat assembly between the opposing leg supports. The crotch pod assembly includes a crotch pod constructed from a shapeable material so that the crotch pod can be contoured and customized for the anatomy of an individual boater. The crotch pad wedges the boater into the cockpit as one with the kayak so that the boater's movements exert an additional control over the guidance of the watercraft. The contoured leg supports, crotch pod, and thigh braces are contoured and arranged to accommodate the boater in a kinesthetic manner whereby the movements of the boater are imparted to the watercraft for guidance and control.

Advantageously, the opposing leg supports are tapered upwardly toward the crotch pod from the buttock support of the contoured seat, and the leg supports are also tapered upwardly toward the crotch pod from the direction of the thigh braces. The crotch pod includes opposing inner thigh supports which engage the inner thighs of the boater in a manner that the lateral leg strength of the boater applies torque to the kayak for guiding and controlling the kayak with less paddling. An adjustment mechanism is provided for adjusting the position of the crotch pod on the medial portion in a longitudinal direction relative to a longitudinal axis of the kayak. The adjustment mechanism includes a slide mount carried between the crotch pod and the medial portion of the contoured seat. The slide mount is comprised of a reinforcement plate carried by the crotch pod. The reinforcement plate is embedded in the shapeable material of the crotch pod and is comprised of barbs protruding outwardly for engaging the shapeable material. An elongated slot is formed in the reinforcement plate, and a connector extends through the elongated slot connecting the plate with the medial portion of the contoured seat. The connector has a first position in which the crotch pod may slide longitudinally to adjust the longitudinal position of the crotch pod to fit the boater, and a second position in which the crotch pod is fixed against movement in the fit position.

Preferably, the crotch pod includes first and second inner thigh supports which converge inwardly toward the boater when seated in the seat assembly. A cut-out is formed in the crotch pod between the inner thigh supports and the reinforcement plate is affixed in the cut-out and embedded in the crotch pod. The crotch pod includes a shapeable block of foam so that the inner thigh supports may be contoured and customized to the boater.

The seat assembly includes a rear deck and lower back support which includes a console carried by the rear deck having a support cushion. The console includes a storage container. The rear deck comprises a protuberance and the console comprises a recess in which the protuberance is fitted when mounted to the rear deck with at least one fastener for securing the console over the protuberance in a fitted relation. The lower back support includes a shapeable material which may be contoured to a back portion of a boater to provide a customized fit for comfort and ease of entrance and exiting from said seat cockpit.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is an additional view taken along line 2—2 of FIG. 1;

FIG. 3 is a sectional view taken along line 3—3 of FIG. 1;

DESCRIPTION OF A PREFERRED EMBODIMENT

Figure 1:
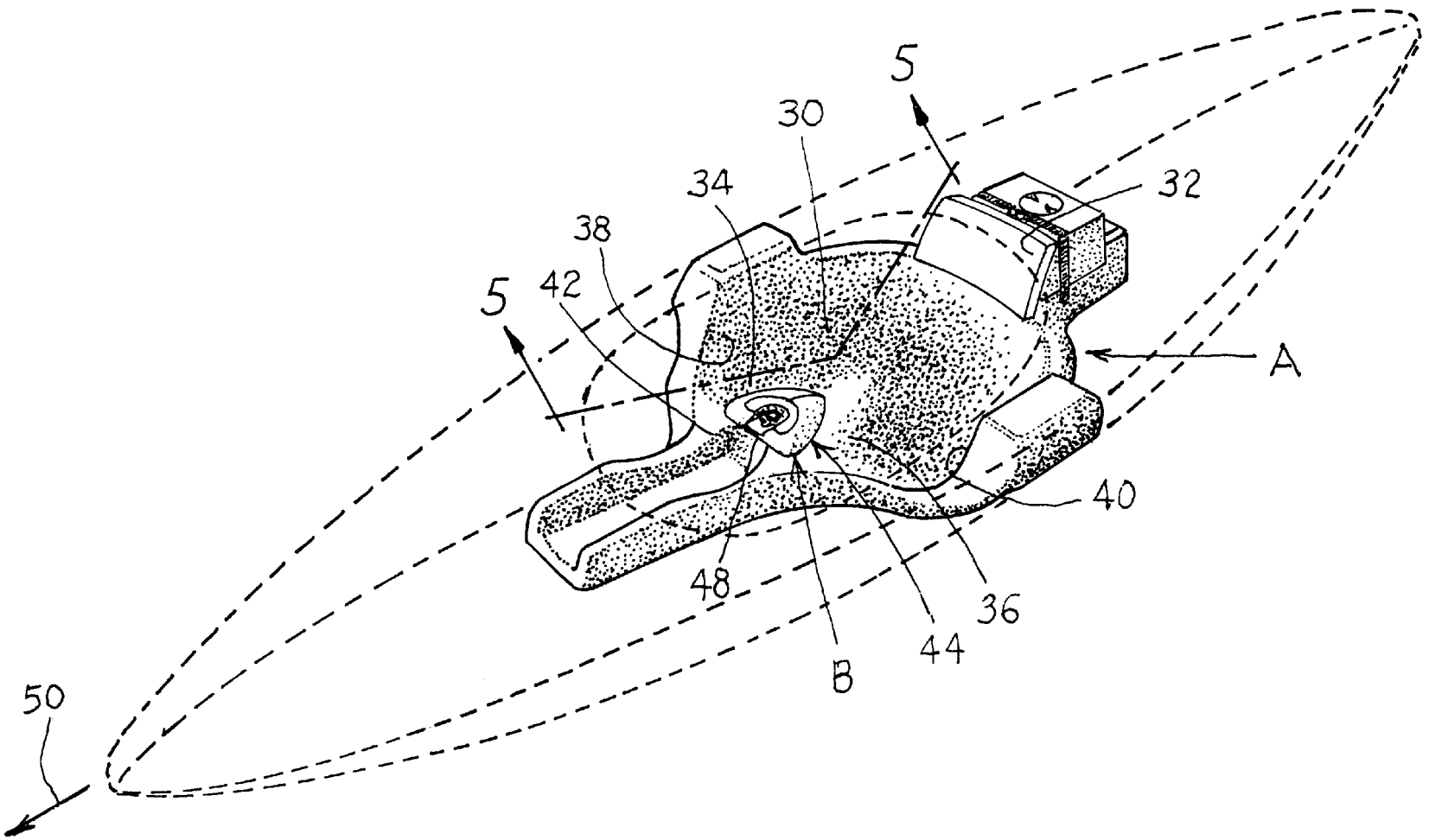
FIG. 1 is prospective view illustrating a kinesthetic seat assembly for a kayak cockpit constructed according to the present invention.

The invention relates to a kinesthetic seat assembly for the cockpit of a water craft such as a kayak and the like which enables the boater to impart a degree of kinesthetic control to the movement and guidance of the watercraft while being more safely supported in the watercraft.

Referring now in more detail to the drawings, a kayak 10 is illustrated having a hull 12 with an upper deck 14 in which a cockpit opening 16 is formed which permits entry and egress to and from the cockpit 18 of the kayak in which a boater 20 sits. Opposing thigh braces 22 are typically carried by the hull inside the cockpit. Disposed within the cockpit of the kayak is a kinesthetic seat assembly, designated generally as A, constructed in accordance with the invention.

Typically, hull 10 is formed of a flexible skin material such as a cross-linked polyethylene material. The hull is typically made by utilizing conventional rotational molding techniques or by utilizing vacuum molding techniques to provide a continuous enclosed hull and deck with central cockpit opening 16 formed in the deck. Fiberglass and other material may also be utilized in such watercraft.

Referring now in more detail to kinesthetic seat assembly A, the seat assembly includes a contoured seat having a buttock support 30, a lower back support 32, and a pair of opposing upper leg supports 34 and 36. The seat's assembly further includes a pair of opposing contoured hip supports 38 and 40. A medial portion 42 of the seat assembly is formed between opposing thigh supports 34 and 36. A crotch support pod assembly, designated generally as B, is carried by medial portion 42 of the seat assembly for supporting and protecting the boater against forward thrust upon impact.

Figure 4:
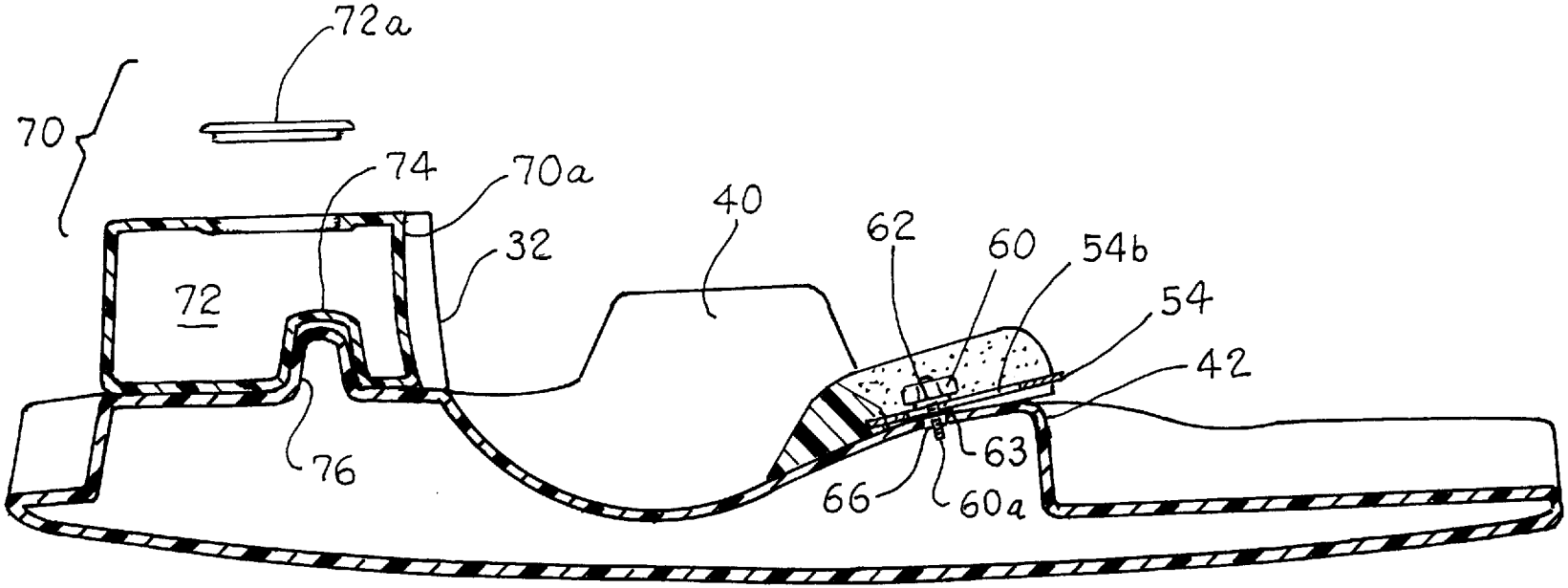
FIG. 4 is a prospective view of a crotch support pod constructed according to the present invention.
Figure 5:
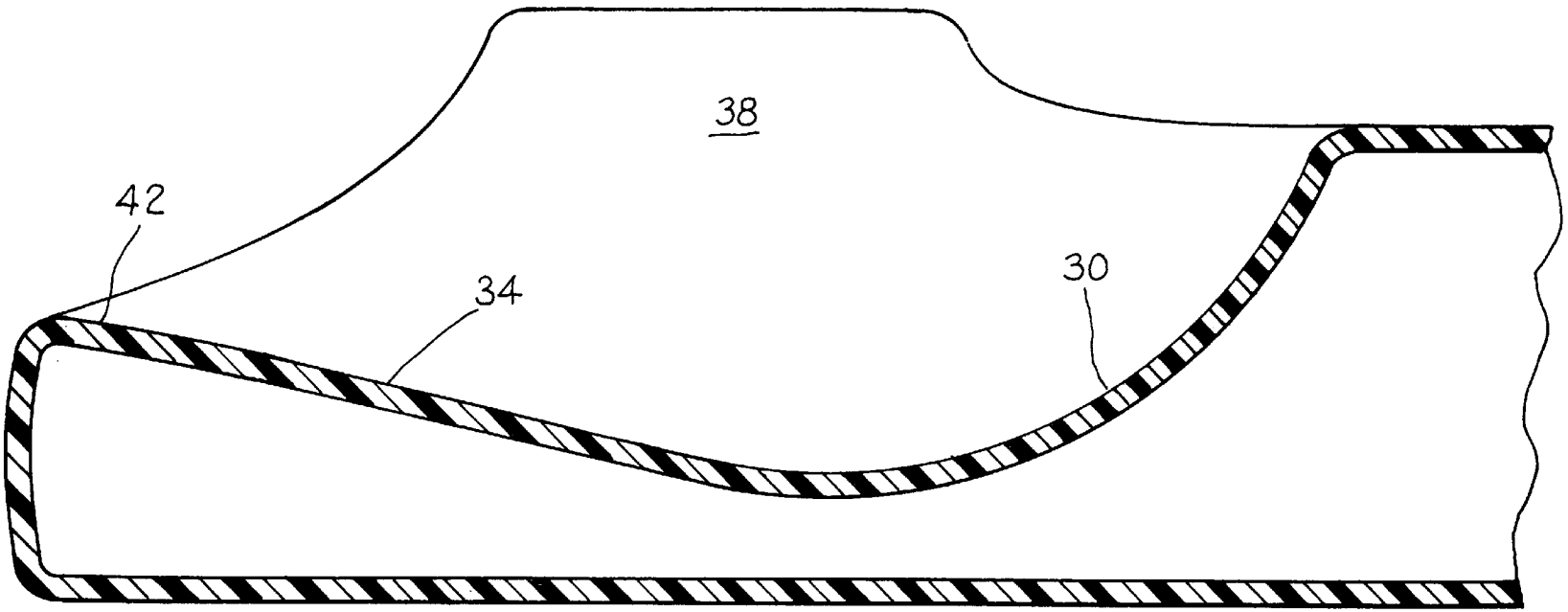
FIG. 5 is a prospective view with parts separated of a crotch support pod constructed according to the present invention.

As can best be seen in FIG. 1, crotch pod assembly B includes a crotch pod 44 constructed from an impact absorbing material. Preferably the material of the crotch pod is formed from a shapeable material so that the pod may be shaped by sanding or other abrasion, or cutting, to fit the inner thigh portions of the boater. Any suitable resilient or cushioning material may be utilized which is shapeable such as an MD200 swirl foam. Crotch pod 44 includes a first inner thigh support surface 46*a* and a second inner thigh support surface 46*b*. A longitudinal adjustment mechanism, designated generally as 48, is provided for mounting the crotch pod to the medial portion of the seat so that the position of crotch pod 46 may be adjusted in its longitudinal position along the center line or longitudinal axis of the kayak. Preferably, the longitudinal adjustment mechanism includes a slide mount in the form of a reinforcement plate 54 embedded in the foam material of pod 44. For this purpose, a narrow slot 46*c* may be provided in the pod for receiving the reinforcement plate. As can be seen, pod 46 is in the form of a generally v-shaped wedge with a cut-out 56 formed between first and second inner thigh supports 46*a* and 46*b*. Reinforcement plate 54 is received in the cut-out. Barbed projections 54*a* extend outwardly on both sides of reinforcement plate 54 to engage in the foam material and, together with an adhesive, secure the reinforcement plate in place. A slot 54*b* provides longitudinal adjustment of the pod. To complete the slidable mount and longitudinal adjustment mechanism, a connector in the form of a hand screw knob 60 and a threaded bolt 60*a* extends through a washer 62 and a rubber grommet 63 to be received in a threaded bore 64 provided in a brass insert 66 (FIGS. 2 and 4). By tightening the hand screw knob the connector may lock the slide mount in a desired longitudinal position corresponding to the desired position of the crotch pod as needed for proper support. The connector has a first, loosened position wherein pod 44 may be adjusted to properly engage the boater. The connector has a second, tightened position wherein the pod is locked in place.

As can best be seen in FIGS. 2 and 4, carried near the rear of the seat assembly is a lower back support assembly, designated generally as 70, which includes a console 70*a* having a lower contoured back support 32, and a container 72 which may be formed as one piece. Lower back support 32 is provided by a pad of resilient foam, such as MD200 swirl foam. Means for mounting the console includes a recess 74 formed in a bottom portion of the container in which a protuberance 76 molded as one piece with a rear deck of the seat assembly is received. A strap 78 completes the mounting which is secured over the rear console 70*a* of the seat assembly and fastened to the rear deck. Container 72 includes a cover 72*a* which may be opened and closed for storing miscellaneous items. It will be noted that the lower back support is secured to the console and the console is secured firmly to the seat assembly and cannot twist or lift off as long as strap 78 is secure.

What is claimed is:

1. A water craft for use in white water conditions comprising:

a hull having an upper deck;

a cockpit opening formed in said upper deck of said hull for entering and exiting an interior cockpit of said watercraft;

a kinesthetic seat assembly carried within said hull being accessible through said cockpit opening;

a pair of opposing thigh braces carried within said cockpit on opposing sides of said seat assembly;

said seat assembly having a contoured seat;

said contoured seat including a pair of opposing contoured upper leg supports, a contoured buttock support portion, and a contoured lower back support;

a medial portion formed between said opposing upper leg supports;

a crotch pod assembly carried by said medial portion of said seat assembly between said opposing leg supports, said crotch pod assembly including a crotch pod constructed from a shapeable material so that said crotch pod can be contoured and customized for the anatomy of an individual boater; and said contoured leg supports, crotch pod, and thigh braces being contoured and arranged to accommodate said boater in a kinesthetic manner so that movements of said boater can be imparted to said watercraft for guidance and control.

2. The kayak of claim 1 wherein said opposing thigh supports taper upwardly toward said crotch pod from said buttock support of said contoured seat.

3. The kayak of claim 2 wherein said leg supports taper upwardly toward said crotch pod from the direction of said thigh braces.

4. The kayak of claim 1 wherein said crotch pod includes opposing inner thigh supports which engage the inner thighs of the boater in a manner that the lateral leg strength of said boater can apply torque to the kayak for guiding and controlling the kayak with less paddling.

5. The kayak of claim 1 including an adjustment mechanism for adjusting the position of said crotch pod on said medial portion in a longitudinal direction relative to a longitudinal axis of said kayak.

6. The kayak of claim 5 wherein said adjustment mechanism includes a slide mount carried between said crotch pod and said medial portion of said contoured seat.

7. The kayak of claim 6 wherein said slide mount comprises;

a reinforcement plate carried by said crotch pod;

an elongated slot formed in said plate; and a connector extending through said elongated slot which connects said plate with said medial portion of said contoured seat.

8. The kayak of claim 7 wherein said connector has a first position in which said crotch pod can slide longitudinally to adjust the longitudinal position of said crotch pod to fit said boater; and said connector having a second position in which said crotch pod is fixed against movement.

9. The kayak of claim 8 wherein said reinforcement plate is embedded in said shapeable material of said crotch pod.

10. The kayak of claim 9 wherein said reinforcement plate comprises barbs protruding outwardly from said reinforcement plate for engaging in said shapeable material.

11. The kayak of claim 10 wherein said crotch pod includes a first inner thigh support and a second inner thigh support which converge inwardly toward said boater when seated in said seat assembly; and a cut-out formed in said crotch pod between said inner thigh supports; and said reinforcement plate being affixed in said cut-out and embedded in said crotch pod.

12. The kayak of claim 11 wherein said crotch pod includes a shapeable block of foam so that said inner thigh supports can be contoured and customized to said boater.

13. The kayak of claim 1 wherein said seat assembly includes a rear deck, and said lower back support includes a console carried by said rear deck having a support cushion.

14. The kayak of claim 13 wherein said console includes a storage container.

15. The kayak of claim 14 wherein said rear deck comprises a protuberance; and said console comprises a recess in which the protuberance is fitted when mounted to said rear deck; and at least one fastener for securing said console over said protuberance in said fitted relation.

16. The kayak of claim 15 wherein said lower back support includes a shapeable material which comprises a resilient material which can be contoured to a back portion of a boater to provide a customized fit for comfort and ease of entrance and exiting from said seat cockpit.

17. A water craft for use in white water conditions comprising:

a hull;

a cockpit opening formed in said hull for entering and exiting an interior cockpit of said watercraft;

a kinesthetic seat assembly carried within said hull being accessible through said cockpit opening;

said seat assembly having a contoured seat which includes a pair of opposing contoured upper leg supports;

a crotch pod assembly carried by a medial portion of said seat assembly between said opposing upper leg supports;

said crotch pod assembly including a crotch pod constructed from a shapeable material so that said crotch pod can be contoured and customized for the anatomy of an individual boater;

an adjustment mechanism for adjusting the position of said crotch pod on said medial portion in a longitudinal direction relative to a longitudinal axis of said kayak; and said contoured leg supports and crotch pod, being contoured and arranged to accommodate said boater in a kinesthetic manner so that movements of said boater can be imparted to said watercraft for guidance and control.

18. The kayak of claim 17 wherein said opposing leg supports taper upwardly from a rear portion of said seat assembly toward said crotch pod.

19. The kayak of claim 17 wherein said crotch pod includes opposing inner thigh supports which engage the inner thighs of the boater in a manner that the lateral leg strength of said boater can apply torque to the kayak for guiding and controlling the kayak with less paddling.

20. The kayak of claim 17 wherein said adjustment mechanism includes a slide mount carried between said crotch pod and said medial portion of said contoured seat.

21. The kayak of claim 20 wherein said slide mount comprises;

a reinforcement plate carried by said crotch pod;

an elongated slot formed in said plate; and a connector extending through said elongated slot which connects said plate with said medial portion of said contoured seat.

22. The kayak of claim 21 wherein said connector has a first position in which said crotch pod can slide longitudinally to adjust the longitudinal position of said crotch pod to fit said boater; and said connector having a second position in which said crotch pod is fixed against movement.

23. The kayak of claim 22 wherein said reinforcement plate comprises barbs protruding outwardly from said reinforcement plate for engaging in said shapeable material.

24. The kayak of claim 23 wherein said crotch pod includes a first inner thigh support and a second inner thigh support which converge inwardly toward said boater when seated in said seat assembly; and a cut-out formed in said crotch pod between said inner thigh supports; and a reinforcement plate being affixed in said cut-out and embedded in said crotch pod.

25. The kayak of claim 24 wherein said crotch pod includes a shapeable block of foam so that said inner thigh supports may be contoured and customized to fit said boater in a kinesthetic manner.

26. In a watercraft for use in white water conditions having a hull and a cockpit opening formed in said hull for access to a cockpit of said watercraft, and a seat assembly for a boater carried within said hull being accessible through said cockpit opening having a contoured seat with a pair of opposing contoured upper leg supports and a contoured buttock support, an adjustable kinesthetic crotch pod assembly comprising:

a crotch pad assembly carried by a medial portion of said seat assembly between said opposing upper leg supports;

said crotch pod assembly including a crotch pod constructed from a shapeable material which can be shaped so that said crotch pod may be contoured and customized for the anatomy of an individual boater;

an adjustment mechanism mounting said crotch pod to said medial portion of said seat assembly for adjusting the position of said crotch pod on said medial portion in a longitudinal direction relative to a longitudinal axis of said kayak to fit the boater; and said crotch pod being contoured and arranged to accommodate said boater in said seat assembly in a kinesthetic manner so that movements of said boater can be imparted to said watercraft for guidance and control.

27. The kayak of claim 26 wherein said crotch pod includes opposing inner thigh supports which engage the inner thighs of the boater in a manner that the lateral leg strength of said boater can apply torque to the kayak for guiding and controlling the kayak with less paddling; and said crotch pod includes a shapeable block of yieldable foam so that said inner thigh supports may be contoured and customized to said boater.

28. The kayak of claim 26 wherein said adjustment mechanism includes a slide mount carried between said crotch pod and said medial portion of said contoured seat.

29. The kayak of claim 28 wherein said slide mount comprises;

a reinforcement plate carried by said crotch pod;

an elongated slot formed in said plate; and a connector extending through said elongated slot which connects said plate with said medial portion of said contoured seat.

30. The kayak of claim 29 wherein said connector has a first position in which said crotch pod can slide longitudinally to adjust the longitudinal position of said crotch pod to fit said boater; and said connector having a second position in which said crotch pod is fixed against movement in said fit position.

31. The kayak of claim 30 wherein said reinforcement plate is embedded in said shapeable material of said crotch pod, and said reinforcement plate comprises barbs protruding outwardly from said reinforcement plate for engaging in said shapeable material.

32. The kayak of claim 31 wherein said crotch pod includes a first inner thigh support and a second inner thigh support which converge inwardly toward said boater when seated in said seat assembly; and a cut-out formed in said crotch pod between said inner thigh supports; and said reinforcement plate being affixed in said cut-out and embedded in said crotch pod.

* * * * *